US010589918B2

(12) United States Patent
DeVerney et al.

(10) Patent No.: US 10,589,918 B2
(45) Date of Patent: Mar. 17, 2020

(54) MICROWAVEABLE PRODUCT

(75) Inventors: Anthony David DeVerney, Naperville, IL (US); Jeffrey Anthony Czarny, Schaumburg, IL (US)

(73) Assignee: The Hillshire Brands Company, Chicago, IL (US)

( * ) Notice: Subject to any disclaimer, the term of this patent is extended or adjusted under 35 U.S.C. 154(b) by 1501 days.

(21) Appl. No.: 12/364,443

(22) Filed: Feb. 2, 2009

(65) Prior Publication Data

US 2009/0196960 A1 Aug. 6, 2009

Related U.S. Application Data

(60) Provisional application No. 61/063,675, filed on Feb. 5, 2008.

(51) Int. Cl.
*B65D 81/34* (2006.01)

(52) U.S. Cl.
CPC ..... *B65D 81/3453* (2013.01); *B65D 2205/02* (2013.01); *B65D 2581/3405* (2013.01); *B65D 2581/3425* (2013.01); *B65D 2581/3455* (2013.01); *B65D 2581/3464* (2013.01); *B65D 2581/3497* (2013.01); *B65D 2581/3498* (2013.01)

(58) Field of Classification Search
CPC ..... B65D 81/3446; B65D 2581/3497; B65D 2581/3494
USPC ..... 420/107; 426/107, 234, 243; 219/730
See application file for complete search history.

(56) References Cited

U.S. PATENT DOCUMENTS

| | | | | |
|---|---|---|---|---|
| 3,243,068 | A | 3/1966 | Huston | |
| 3,550,421 | A * | 12/1970 | Stakel | B21D 51/2646 493/154 |
| 3,946,187 | A | 3/1976 | MacMaster et al. | |
| 3,994,212 | A | 11/1976 | Wong | |
| 4,023,174 | A | 5/1977 | Wright | |
| 4,121,510 | A | 10/1978 | Frederick | |
| 4,140,889 | A | 2/1979 | Mason, Jr. et al. | |
| 4,141,771 | A | 2/1979 | Barker et al. | |
| 4,186,217 | A | 1/1980 | Tchack | |
| 4,190,757 | A | 2/1980 | Turpin et al. | |
| 4,225,052 | A | 9/1980 | Tector et al. | |

(Continued)

FOREIGN PATENT DOCUMENTS

| | | |
|---|---|---|
| EP | 0 492 052 B1 | 7/1992 |
| GB | 2280342 A | 1/1995 |

(Continued)

OTHER PUBLICATIONS

"Robbie's Recipe Collection" Aug. 18, 2006 http://web.archive.org/web/20060818081847/http://recipes.robbiehaf.com/C/227.htm.*

(Continued)

*Primary Examiner* — Viren A Thakur
(74) *Attorney, Agent, or Firm* — Duane Morris LLP

(57) ABSTRACT

A microwaveable product can include a container with an interior and a fluted first sidewall. The product can include a susceptor. The susceptor can be disposed within the container interior. The susceptor can have a fluted second sidewall. The fluted second sidewall can conform to the fluted first sidewall. A food product can be disposed in the interior. The food product can conform to the fluted second sidewall. Microwave energy can reach the food product via the susceptor.

15 Claims, 5 Drawing Sheets

(56) References Cited

U.S. PATENT DOCUMENTS 4,230,924 A 10/1980 Brastad et al.
4,260,060 A 4/1981 Faller
4,267,420 A 5/1981 Brastad
4,268,738 A 5/1981 Flautt, Jr. et al.
4,362,917 A 12/1982 Freedman et al.
4,398,077 A 8/1983 Freedman et al.
4,404,241 A 9/1983 Mueller et al.
4,416,906 A 11/1983 Watkins
4,416,907 A 11/1983 Watkins
4,425,368 A 1/1984 Watkins
4,428,281 A 1/1984 Miller
4,441,626 A * 4/1984 Hall ..... B31F 1/2813 229/120
4,450,180 A 5/1984 Watkins
4,548,826 A 10/1985 Watkins
4,553,010 A 11/1985 Bohrer et al.
4,555,605 A 11/1985 Brown et al.
4,560,580 A 12/1985 Needham et al.
4,567,341 A 1/1986 Brown
4,590,349 A 5/1986 Brown et al.
4,592,914 A 6/1986 Kuchenbecker
4,594,492 A 6/1986 Maroszek
4,612,431 A 9/1986 Brown et al.
4,626,641 A 12/1986 Brown
4,641,005 A 2/1987 Seiferth
4,642,434 A 2/1987 Cox et al.
4,661,671 A 4/1987 Maroszek
4,663,506 A 5/1987 Bowen et al.
4,698,472 A 10/1987 Cox et al.
4,703,148 A 10/1987 Mikulski et al.
4,705,929 A 11/1987 Atkinson
4,735,513 A 4/1988 Watkins et al.
4,742,203 A 5/1988 Brown et al.
4,745,249 A 5/1988 Daniels
4,775,771 A 10/1988 Pawlowski et al.
4,777,053 A 10/1988 Tobelmann et al.
4,780,587 A 10/1988 Brown
4,794,005 A 12/1988 Swiontek
4,820,893 A 4/1989 Mode
4,825,025 A 4/1989 Seiferth
4,841,112 A * 6/1989 Peleg ..... B65D 81/3453 219/730
4,870,233 A 9/1989 McDonald et al.
4,874,917 A * 10/1989 Weimer ..... 219/728
4,904,324 A 2/1990 Heider
4,923,704 A 5/1990 Levinson
4,943,439 A 7/1990 Andreas et al.
5,053,594 A * 10/1991 Thota et al. ..... 219/730
5,075,526 A 12/1991 Sklenak et al.
5,106,635 A * 4/1992 McCutchan et al. ..... 426/107
5,211,975 A * 5/1993 Mendenhall et al. ..... 426/107
D336,041 S * 6/1993 Zama ..... D9/429
5,256,365 A 10/1993 Gordon et al.
5,310,977 A 5/1994 Stenkamp et al.
5,343,024 A 8/1994 Prosise et al.
5,370,042 A 12/1994 Tolchin et al.
5,423,477 A * 6/1995 Valdman ..... A47J 47/145 206/551
5,585,027 A * 12/1996 Young ..... 219/730
5,662,237 A * 9/1997 Cain ..... B65D 43/162 220/368
5,698,306 A * 12/1997 Prosise ..... B65D 81/3446 219/730
5,741,534 A * 4/1998 Chung ..... 426/120
5,770,840 A * 6/1998 Lorence ..... B65D 77/0433 219/730
5,910,268 A 6/1999 Keefer
6,137,099 A * 10/2000 Hamblin ..... B65D 5/2038 219/730
6,251,451 B1 6/2001 Zeng
6,293,458 B1 9/2001 Sarnoff
D452,433 S 12/2001 Lazaris
D452,434 S 12/2001 Sweeney
6,476,368 B2 11/2002 Aronsson et al.
6,501,059 B1 12/2002 Mast
D474,110 S 5/2003 Sweeney
D474,111 S 5/2003 Lazaris
6,627,862 B1 9/2003 Pedersen
6,717,121 B2 * 4/2004 Zeng ..... A47J 36/027 219/728
6,818,873 B2 11/2004 Savage et al.
6,903,320 B2 6/2005 Cutler et al.
7,019,271 B2 * 3/2006 Wnek et al. ..... 219/730
7,141,771 B2 11/2006 Hopkins, Sr.
2001/0032843 A1 * 10/2001 Aronsson et al. ..... 219/730
2002/0020702 A1 2/2002 Matsuno et al.
2002/0112614 A1 * 8/2002 Zoss ..... A21B 3/131 99/426
2002/0122907 A1 * 9/2002 Whitmore ..... B32B 27/08 428/35.7
2003/0087015 A1 * 5/2003 Wyslotsky ..... A23B 7/148 426/397
2004/0023000 A1 2/2004 Young et al.
2004/0108313 A1 * 6/2004 Cutler ..... A47J 36/027 219/730
2005/0173425 A1 8/2005 Wnek et al.
2007/0102319 A1 5/2007 Sperrazza
2007/0210092 A1 * 9/2007 Mazzarolo ..... 220/643
2007/0215611 A1 9/2007 O'Hagan et al.
2007/0262487 A1 11/2007 O'Hagan et al.
2009/0041905 A1 * 2/2009 Markillie et al. ..... 426/86
2009/0186133 A1 * 7/2009 Bjork et al. ..... 426/234

FOREIGN PATENT DOCUMENTS

JP 62-158929 A 7/1987
JP 2001/019062 A 1/2001
WO WO 2002/062552 A1 8/2002
WO WO 2004/052769 A2 6/2004
WO WO 2006/098950 9/2006
WO WO 2006/098950 A2 9/2006
WO WO 2009/032572 A2 3/2009

OTHER PUBLICATIONS

Definition of "along" retrieved Jul. 25, 2017.*
Definition of "fluted" retrieved Jul. 25, 2017.*
Definintion of "conform" obtained Nov 29, 2017.*
Hansen, Diana Williams. "Turning Out a Correct Quiche" Mar. 3, 1998 http://articles.latimes.com/1988-03-03/food/fo-506_1_quiche-dish (Year: 1998).*
Recipelink.com, Dec. 27, 2005 https://www.recipelink.com/msgbrd/board_31/2005/DEC/35955.html (Year: 2005).*
International Search Report and Written Opinion for International Application No. PCT/US2008/074150, dated Mar. 3, 2009, 15 pages.
Communication Relating to the Results of the Partial International Search for International Application No. PCT/US2009/032833; dated May 15, 2009; 4 pages.
International Search Report for International Application No. PCT/US2003/38429; dated Sep. 2, 2004; 1 page.
International Search Report and Written Opinion for International Application No. PCT/US2009/032833, dated Jul. 27, 2009, 20 pages.
Warm Delights Minis Photo, representative of Betty Crocker food product commercially available at least by Jan. 15, 2009, 1 page.
Microwave Performance, Graphic Packaging Holding Company, "Microwave packaging satisfies more with quick and tasty cooking," accessed at http://www.graphicpkg.com/innovation/Pages/MicrowavePackagingSolutions.aspx on Sep. 21, 2009, 2 pages.
Mexican Office Action dated May 21, 2013, issued in MX/A/2010/008574.
Canadian Intellectual Property Office, Canadian Office Action issued in counterpart Application No. 2714278 dated Mar. 17, 2015, 1pg.

* cited by examiner

MICROWAVEABLE PRODUCT

CROSS-REFERENCE TO RELATED PATENT APPLICATIONS

This application claims the benefit of U.S. Provisional Application No. 61/063,675, filed Feb. 5, 2008, which is incorporated by reference herein in its entirety.

BACKGROUND

The present disclosure relates generally to the field of microwaveable products, and more specifically, to microwaveable products including microwaveable food products and packages that permit fully baking a raw and/or frozen microwaveable food product.

Microwaveable food products and packages for microwaveable food products are generally known. However, there are many challenges associated with microwaving food products, particularly when the food products are microwaveably baked from a raw and/or fully frozen state.

For example, conventional packages that utilize susceptors often do not provide appropriate contact between the susceptor material and the surface of the food product, resulting in reduced heat transfer between the susceptor and the food product. Furthermore, many microwaveable products that utilize susceptors are not properly vented, resulting in unwanted moisture being reabsorbed into the food product.

Accordingly, it would be advantageous to provide a microwaveable package having a susceptor that maintains intimate contact with the food product and provides improved ventilation of moisture produced by the food product.

SUMMARY

One embodiment relates to a microwaveable product comprising a container having an interior and a fluted first sidewall, the fluted first sidewall including a plurality of flutes extending about the perimeter of the container, a susceptor provided within the interior and having a fluted second sidewall, and a food product provided within the interior, the food product substantially conforming to the shape of the fluted second sidewall.

Another embodiment relates to a microwaveable product comprising a container having an interior, a susceptor provided within the interior and having a sidewall with a plurality of flutes, a food product provided within the interior, the food product comprising a first layer provided in an unbaked state and a second layer provided in an at least partially-baked state, and a cover coupled to the container to enclose the susceptor and the food product within the interior.

Another embodiment relates to a microwaveable product comprising a container having a bottom and a first sidewall extending from the bottom to a first height, and a susceptor having a second sidewall extending along the first sidewall from the bottom to a second height that is less than the first height.

DETAILED DESCRIPTION OF EXEMPLARY EMBODIMENTS

Figure 1:
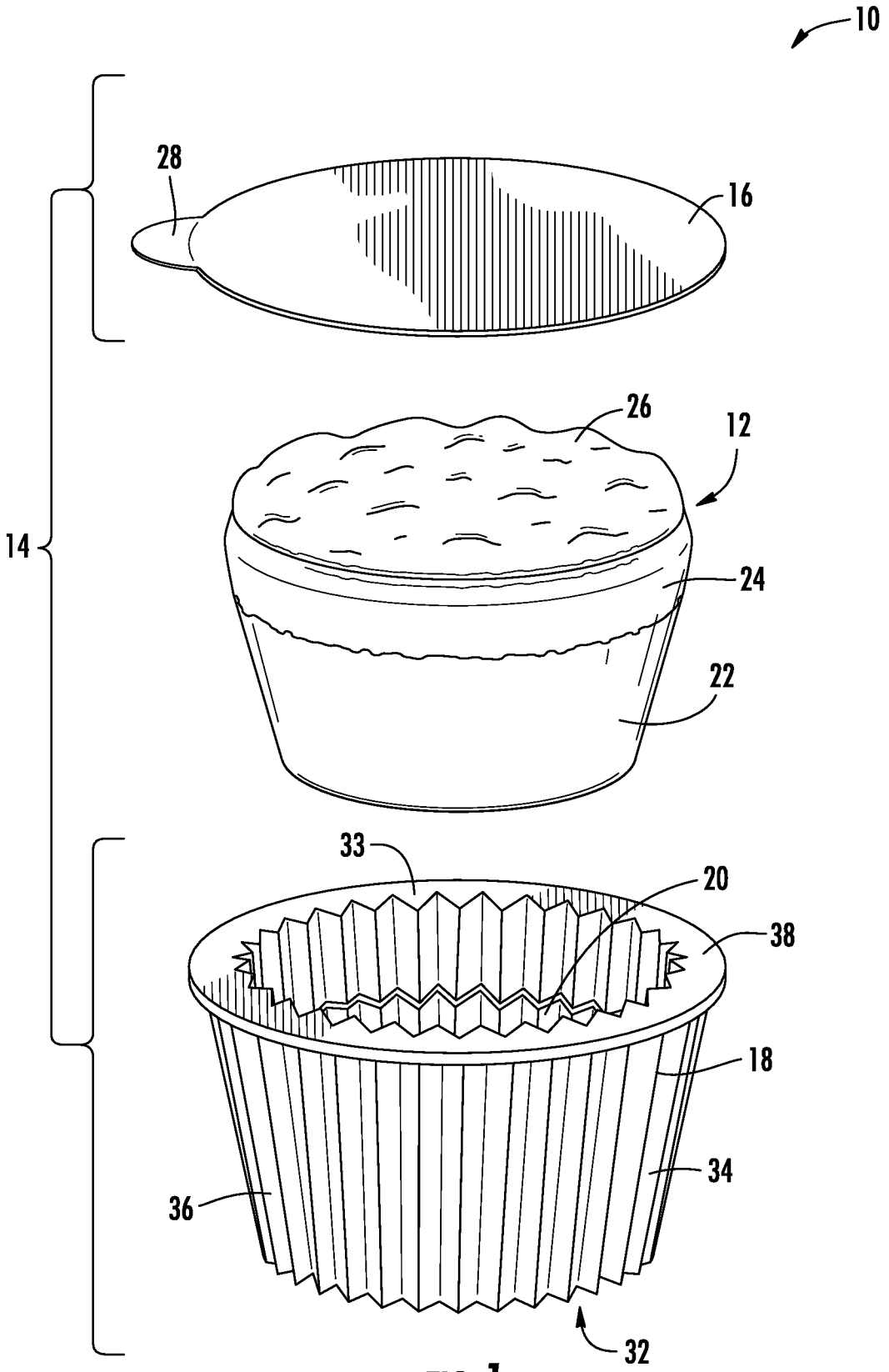
FIG. 1 is an exploded perspective view of a microwaveable product according to an exemplary embodiment.
Figure 2:
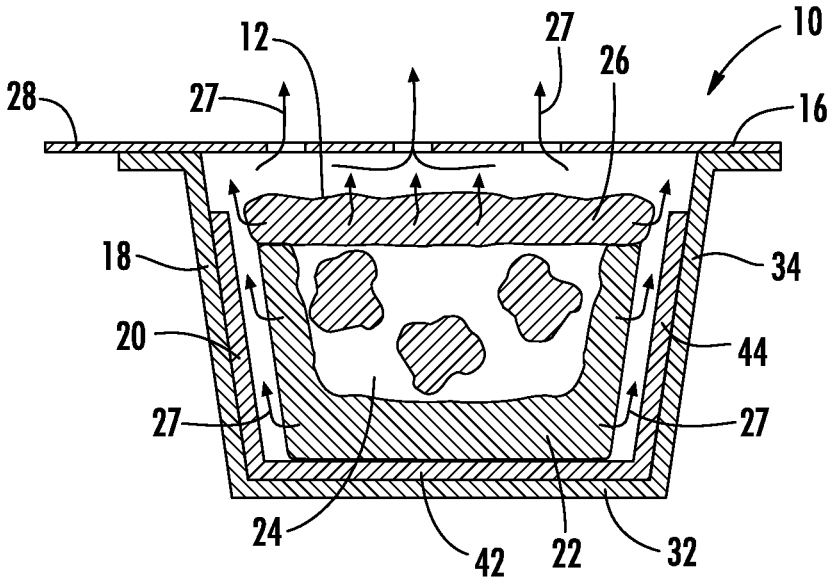
FIG. 2 is a cross-sectional view of the microwaveable product of FIG. 1 according to an exemplary embodiment.
Figure 3:
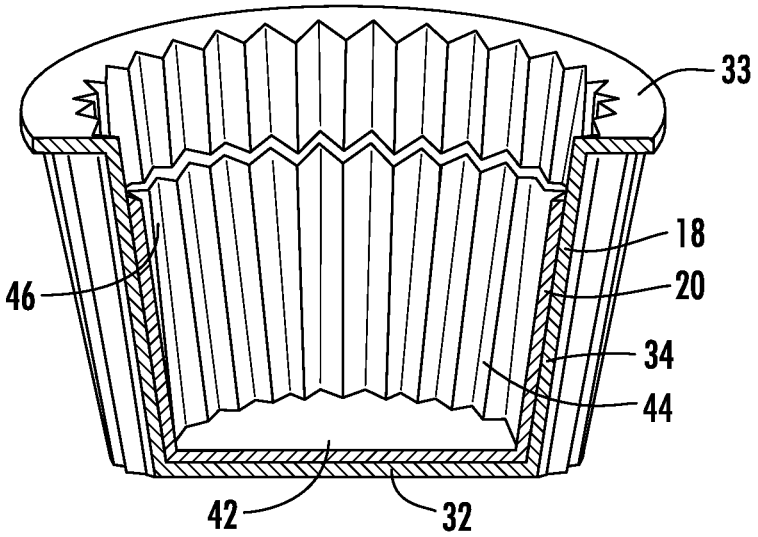
FIG. 3 is a cross-sectional perspective view of a portion of the microwaveable product of FIG. 1 according to an exemplary embodiment.

Referring to FIGS. 1-3, a microwaveable product 10 is shown according to an exemplary embodiment and includes a food product 12 (e.g., a microwaveable food product, such as a breakfast, lunch, or dinner meal, etc.) and a package 14 (e.g., a freezable, refrigeratable, and/or microwaveable package, etc.). Package 14 includes a cover 16 (e.g., a lid, top, sealing member, etc.), a container 18 (e.g., a cup, bowl, tray, etc.), and a susceptor 20 (e.g., a microwave-interactive layer, film, or laminate, etc.). According to an exemplary embodiment, microwaveable product 10 may be provided to consumers as a frozen product (e.g., such that food product 12 is provided in frozen form). According to various alternative embodiments, product 10 may be provided to consumers as a refrigerated product or a non-refrigerated, non-frozen product (e.g., at room temperature).

According to an exemplary embodiment, as shown in FIG. 2, food product 12 may include one or more of a first or raw dough component 22 (e.g., a breakfast dough, raw dough, etc.), a second component 24 (e.g., eggs, meat, cheese, protein sources, a combination thereof, a frozen, fully-cooked component, etc.), and a third component 26 (e.g., cheese, cheese sauce, gravy, a cooked/uncooked, fully frozen component, etc.). According to one embodiment, food product 12 may weigh approximately five ounces when fully baked. According to various alternative embodiments, food product 12 may weigh more or less than five ounces when fully baked. The components of food product 12 may be selected based in part on moisture/fat content and expected steam/moisture release due to microwave baking. While food product 12 is generally referred to herein as a breakfast meal, other types of food products may be used, including various types of snacks, lunches, dinners, and so on (e.g., portable breakfasts, multi-component breakfasts or meals, a quiche, etc.). Furthermore, while food product 12 may be referred to as a frozen food product, alternatively, food product 12 may be a refrigerated or non-refrigerated food product.

Raw dough component 22 may be, for example, a non-proof "Danish biscuit" formula that provides a fresh-baked appeal and flavor. The make-up of raw dough component 22 may be based upon the moisture and/or fat contents of the dough and the release of moisture from the dough. Other components of food product 12 may include eggs, meat, cheese, sauces, gravies, etc. to provide a unique finished product and optimized performance of the microwaveable product. Furthermore, various types of "flavored"/"unflavored" doughs may be used as part of food product 12.

As shown in FIGS. 1-3, according to an exemplary embodiment, cover 16 may be a flexible cover that may be made from a foil film or fiber/paper material, and sealed to container 18. Cover 16 may be removably coupled to container 18 to enclose food product 12 and susceptor 20 within container 18. Cover 16 may be coupled to container 18 in a variety of ways, including heat sealing, adhesives, sonic welding, induction sealing, etc. Cover 16 may be a self-venting cover having a low-barrier construction such that steam and moisture may pass through cover 16 (e.g., through perforations, holes, etc.). According to an exemplary embodiment, cover 16 may include one or more temperature-sensitive vent portions that are configured to open or dilate upon the temperature and/or pressure within container 18 reaching a predetermined level such that steam generated within container 18 is permitted to escape. Other ways of providing venting through cover 16 may be used according to various alternative embodiments, including perforations, apertures, etc. For example, cover 16 may be provided with a "tear-away" portion that a user may remove (e.g., tear off, peel away, etc.) prior to baking to ensure proper venting. According to an exemplary embodiment, between ten and fifteen percent of the surface area of cover 16 is vented in order to provide proper moisture exhaust during baking of food product 12.

According to one embodiment, cover 16 includes one or more tabs 28 (e.g., pull-tabs, extended portions, etc.) that extend beyond container 18 such that a user may easily grasp tab 28 and remove cover 16 from container 18 (e.g., an "easy-peel" type configuration). Other ways for permitting a user to remove cover 16 may be used according to various alternative embodiments. Cover 16 may also have one or more portions having graphics, text, etc., intended to provide consumers with various types of information, including ingredient information, nutritional information, preparation instructions, and so on. Other types of information may be provided on cover 16 according to various other embodiments.

While cover 16 is shown in FIGS. 1-3 as a flexible cover, according to various other exemplary embodiments, cover 16 may be provided in other forms. For example, rather than a flexible foil/film or fiber-paper cover, cover 16 may be a rigid or semi-rigid polymer (e.g., polypropylene, etc.), such as cover 150 shown in FIG. 4. According to an exemplary embodiment, cover 16 may be provided with a susceptor (e.g., on an inner surface) to provide browning/crisping to one or more portions of the top of food product 12 (e.g., a pot-pie, etc.). Furthermore, cover 150 and cover 16 may be used in combination with each other, such that both a flexible cover component and a rigid cover component are provided (as also discussed with respect to FIG. 6). Furthermore, cover 16 may be provided as a tamper-resistant cover intended to prevent tampering with food product 12 within container 18. Further yet, cover 16 and/or cover 150 may be provided with a laminate layer (e.g., a clear-coat polymer layer) provided on the inner surface of the cover to provide a surface texture intended to inhibit the formation of beads due to moisture accumulation and facilitate the venting of moisture through cover 16 and/or cover 150. Further, cover 16 and/or cover 150 may be omitted entirely and/or during the microwaving of food product 12.

Referring further to FIGS. 1-2, according to one embodiment, susceptor 20 is a thin-gauge susceptor and includes a bottom 42 and a sidewall 44 that extends from bottom 42. Sidewall 44 extends from bottom 42 at an incline (e.g., a slope, draft, or other non-perpendicular surface) such that the diameter of susceptor 20 increases from bottom to top (e.g., in a shape similar to a conventional muffin tin liner or baking cup). This configuration facilitates insertion and removal of food product 12 from susceptor 20 and minimizes the amount of food product 12 that may stick or otherwise be retained by susceptor 20 and/or container 18 after baking. Susceptor 20 facilitates the browning or crisping of food product 12 in order to provide a desirable texture to the exterior of food product 12 by absorbing a portion of the microwave energy that would otherwise pass through to food product 12. The absorbed microwave energy is converted into heat by susceptor 20 and transferred to the surface of food product 12. In some embodiments, susceptor 20 may be a laminate made up of a metal or microwave-interactive layer and one or more protective and/or structural layers. Alternatively, susceptor 20 may be an ink-type susceptor.

As shown in FIGS. 1-3, according to an exemplary embodiment, sidewall 44 of susceptor 20 may have a fluted or corrugated construction such as a fluted formed paper construction or a corrugated formed paper construction (e.g., pleated, zig-zagged, scalloped, accordion-like, wavy-shaped, round-edged, pointed-edged, etc.). According to one embodiment, the corrugated construction includes a number of corrugations, or flutes, 46 that are generally flat, or linear members, and are folded or otherwise angled relative to one another to provide the corrugated construction of susceptor 20. According to one embodiment, corrugations 46 may each have a width or depth (e.g., as measured, in a radial direction extending from the center of container 18) of approximately one-eighth inch. According to various alternative embodiments, the width of corrugations 46 may be increased or decreased (e.g., more or less than one-eighth inch). In some embodiments, corrugations 46 may be of equal sizes and be equally distributed about the circumference of susceptor 20 (e.g., to provide different "pitches" or different numbers of corrugations or flutes per inch). According to other embodiments, corrugations 46 may be different sized and/or be unequally spaced about the circumference of susceptor 20. According to yet other embodiments, corrugations 46 may be provided as non-linear members such as wave-formed members, scallops, etc.

As shown in FIGS. 1-3, container 18 includes a bottom 32 and a sidewall 34. Sidewall 34 may include corrugations 36 that extend about one or both of the inside and outside surfaces of sidewall 34. For example, according to one embodiment, sidewall 34 include corrugations 36 on both the inside and the outside surfaces. Alternatively, corrugations 36 may be provided on only the inside surface of sidewall 34, and sidewall 34 may have a substantially smooth or otherwise-shaped outer surface. Similar to corrugations 46 on susceptor 20, corrugations 46 may be provided in a wide variety of shapes, sizes, and configurations in order to be adapted to a variety of applications. Sidewall 34 of container 18 may extend from bottom 32 to an upper surface, or ledge 33 (e.g., a lip/flange, etc.), which may be a heat-sealable surface intended to provide a mating surface for cover 16. Container 18 may have a high-barrier construction such that container 18 does not permit the release of steam, moisture, etc. from container 18 that may be generated by food product 12.

As shown in FIG. 2, the diameter of container 18 increases from bottom to top, such that sidewall 34 has a sloped configuration relative to bottom 32. This sloped configuration may facilitate venting of food product 12 by permitting moisture escaping from the sides of food product 12 to be "wicked" along sidewall 34 (e.g., along a path shown by arrows 27 in FIG. 2) and toward cover 16, where it may then escape. According to one embodiment, sidewall 34 may have a slope of approximately 6 degrees offset from vertical, although the slope may vary according to various alternative embodiments, such that the slope may be between 5 degrees and 45 degrees, between 6 degrees and 10 degrees, etc. It should be noted that FIG. 2 is shown schematically to illustrate certain features of the embodiment shown therein, and actual sizes and dimensions shown in FIG. 2 are not to scale and the actual components may have differing configurations than those illustrated in FIG. 2.

According to an exemplary embodiment, susceptor 20 is provided as an integral part of container 18 (e.g., such that the susceptor is form-molded, cast or otherwise formed together with the container). For example, susceptor 20 may be provided as a metallic layer that is applied to or otherwise formed or laminated with container 18, such that susceptor 20 includes a layer of metallic material having a corrugated structure substantially similar to that of container 18. Further, as discussed with respect to FIG. 6, container 18 may be formed (e.g., thermoformed) from a generally flat paper material after a generally flat susceptor material is bonded to the paper material. Ledge 33 may be provided as an injection-molded feature (e.g., a polymer component) that is bonded to sidewall 34 of container 18.

According to various alternative embodiments, susceptor 20 may be provided as a separate component from container 18. For example, susceptor 20 may simply be inserted into the interior of container 18, or susceptor 20 may be married or bonded (e.g., chemically, mechanically, via adhesives, a combination thereof, etc.) to container 18. Providing susceptor 20 as a separate component from container 18 may improve moisture exhaust away from the surface of food product 12 by allowing moisture generated by food product 12 to travel upward along susceptor 20 and then travel back downward into the space between susceptor 20 and container 18. Alternatively, susceptor 20 may be a vented susceptor that permits moisture to escape directly through the susceptor material (e.g., through holes, apertures, perforations, slits, etc.). According to any of these embodiments, susceptor 20 and/or container 18 may be provided with an additional release layer intended to facilitate the removal and/or consumption of food product 12 from container 18 and susceptor 20 after baking.

According to an exemplary embodiment, susceptor 20 (whether separate from or integral to container 18) does not extend to the full height of container 18. For example, as shown in FIG. 2, sidewall 44 of susceptor 20 extends approximately eighty percent of the distance from the bottom to the top of sidewall 34 of container 18. For example, if container 18 has a height of 2 inches, susceptor 20 may extend to a height of between 1.7 and 1.9 inches (e.g., approximately 1.8 inches). According to various other embodiments, sidewall 44 of susceptor 20 may extend a greater or lesser distance along sidewall 34 of container 18 (e.g., between 40 percent and 90 percent, between 60 and 85 percent, etc.). Providing susceptor 20 having a relatively shorter height than container 18 permits a portion of food product 12 to extend above susceptor 20, thereby permitting heating (e.g., cooking, baking, etc.) of the top of food product 12 by absorption of the microwaves (rather than conduction or radiation heating by susceptor 20), and avoiding overbaking. In some embodiments, the height of susceptor 20 is based on the make-up of the particular food product used (e.g., fat/moisture content, viscosity, etc.), and may be varied accordingly.

In order to ensure consumer safety, microwaveable product 10 may further be provided with a tamper-resistant feature intended to provide evidence of tampering with product 10. For example, should a flexible cover such as cover 16 be utilized, it may be heat sealed to container 18 such that any tampering with cover 16 would be evident to a consumer. Alternatively, the entirety of product 10 may be shrink-wrapped or otherwise secured within a plastic or other type of material such that tampering would be evident to consumers. Further, one or more components of microwaveable product 10 may include functional barrier properties or features that are intended to maintain a proper environment (e.g., ambient, refrigerated, frozen, etc.) for food products. The barrier features may be customized based on the particular food product and desired environment to control the passage of oxygen, moisture, etc. to and from the food product.

According to an exemplary embodiment, in order to produce microwaveable product 10, container 18 is first provided with susceptor 20 either as an integral part or separately bonded or inserted within container 18. Food product 12 is then introduced into the interior of container 18. In one embodiment, raw dough component 22 is first introduced into container 18 (e.g., in a round or other shape). Raw dough component 22 may be introduced into container 18 in a cooled state (e.g., at a temperature of less than forty degrees Fahrenheit, at ambient temperature, frozen, etc.). According to one embodiment, a manual or automated press mechanism (e.g., a pressing tool having a shape complimentary to the corrugated construction of the container/susceptor) may be used to press raw dough component 22 into container 18 such that raw dough component 22 substantially conforms to the construction of susceptor 20 and/or container 18. Pressing the raw dough into the corrugations ensures intimate contact between the dough and the susceptor material, and in conjunction with the rigidity of the container wall, provides an optimal support feature for the development and baking of the raw dough product. Pressing of the raw dough product is facilitated by the incline, or slope, of sidewall 34.

After introducing raw dough component 22, frozen, fully cooked component 24 may be introduced into container 18. In some embodiments, component 24 may be raw and/or a refrigerated component. After introducing component 24, cooked or uncooked, frozen component 26 may be introduced into container 18. Upon components 22, 24, 26 being introduced into container 18, cover 16 may be coupled to container 18. Further processing, packaging, etc., may be required after securing cover 16 to container 18, after which product 10 may be provided to retail stores and offered for sale to consumers in a frozen state. It should be understood that while food product 12 is described herein as being made up of three distinct component parts 22, 24, 26, food product 12 may comprise more or fewer discrete components of the same or different types and be introduced into container 18 in more or fewer steps than as described herein.

When a consumer wishes to bake (e.g., cook, heat, etc.) microwaveable product 10, the consumer may place product 10 (in a frozen state e.g., from a freezer, in a refrigerated state, in a non-refrigerated and non-frozen (e.g., ambient) state, etc.) within a microwave oven (e.g., a 1000 Watt microwave oven) and bake product 10 for an appropriate time period (e.g., for a period of about 2 minutes and 15 seconds, although baking times may vary between microwave ovens and food product/package types). According to an exemplary embodiment, preparation instructions (e.g., top removal instructions, baking time, etc.) for consumers may be provided on cover 16 and/or container 18. Upon food product 12 being fully baked, the consumer may remove cover 16, and consume food product 12 directly from container 18. Alternatively, the consumer may remove food product 12 from container 18 and place food product 12 on a separate dish (e.g., a plate, cup, bowl, etc.). According to yet another embodiment, one or more utensils (e.g., a spoon, fork, knife, or a combination thereof) may be provided with or integrated into a part of microwaveable product 10 (e.g., a spoon may be removably secured to or formed (e.g., molded, etc.) with container 18 or cover 16, etc.) to provide an all-in-one, on-the-go product for the consumer.

While susceptor 20 and container 18 are shown herein as having sidewalls with corrugated constructions, it should be understood that the corrugations may also be provided on the bottom portions of one or both of susceptor 20 and container 18. Furthermore, while susceptor 20 and container 18 are shown herein as being generally shaped as cups (e.g., similar to a traditional muffin cup), various shapes and sizes may be utilized for susceptor 20 and/or container 18 according to various alternative exemplary embodiments. According to an exemplary embodiment, container 18 may have a height of approximately 2.0 inches, a diameter across the top of about 3.5 inches, and a diameter across the bottom of about 2.5 inches. The dimensions of container 18 may vary according to other embodiments.

It is important to note that microwaveable product 10 shown in FIGS. 1-3 provides many advantages over more conventional microwaveable products. For example, microwaveable product 10 provides a complete meal (e.g., an individual breakfast entree) that may be fully baked from the frozen state in less than 3 minutes (e.g., about 2 minutes and 15 seconds) using an easy-opening, easy-handling, portion controlled, portable container that may be held in a hand such that food product may be consumed directly out of the container.

Furthermore, container 18 lined with susceptor 20 provides optimized heating/baking due to the corrugated/fluted structure of susceptor 20, which, in combination with food product 12 conforming to the corrugated construction of container 18 and/or susceptor 20, increases the amount of heat delivered to food product 12 (relative to non-corrugated configurations) due to the increased surface area and the heat concentrations at the folds, or pleats, between corrugations, which increase delivery of heat to food product 12. Further, the corrugated construction permits moisture released as steam from food product 12 to escape (e.g., though cover 16) and prevents reabsorbtion of moisture which can lead to a soggy, oversaturated, undesirable food product. Moisture release may be further facilitated by the "slope" of sidewalls 34, 44 from bottom to top (e.g., whereby the diameter of the container increases from bottom to top). Such a configuration may promote "wicking" of moisture that is released from the interior of a food product (e.g., to facilitate movement of moisture from below the top portion of container 18 to the top portion of container 18, so that the moisture may escape container 18).

Further yet, the corrugated construction of susceptor 20 and container 18 provides a corresponding corrugated texture to the finished food product, which consumers may find more desirable than an otherwise smooth, rounded surface to the food product. Additionally, the rigidity and slope of container 18 facilitate the deposition and forming of food product 12 (in particular, raw dough component 22, prior to the addition of the remaining components) prior to baking. Also, susceptor 20 provides a browned or crisped surface for the areas of food product 12 in contact with susceptor 20.

Providing a susceptor such as susceptor 20 as an integral part of container 18 also serves to reduce the number of components in the microwaveable product (e.g., by eliminating a separate susceptor component), thereby potentially reducing materials costs for the microwave packaging, reducing assembly costs for the microwaveable product, and providing the user with a single-piece container rather than a container and separate susceptor. Furthermore, container 18 may rest directly on a microwave surface without the need for additional support structures to provide clearance, etc.

The various advantages and features discussed above with respect to FIGS. 1-3 are further applicable to a wide variety of variations with respect to the configuration of the microwaveable products disclosed herein. For example, FIGS. 4-6 illustrate alternative exemplary embodiments of microwaveable products that exhibit many of the features and advantages already discussed herein.

Figure 4:
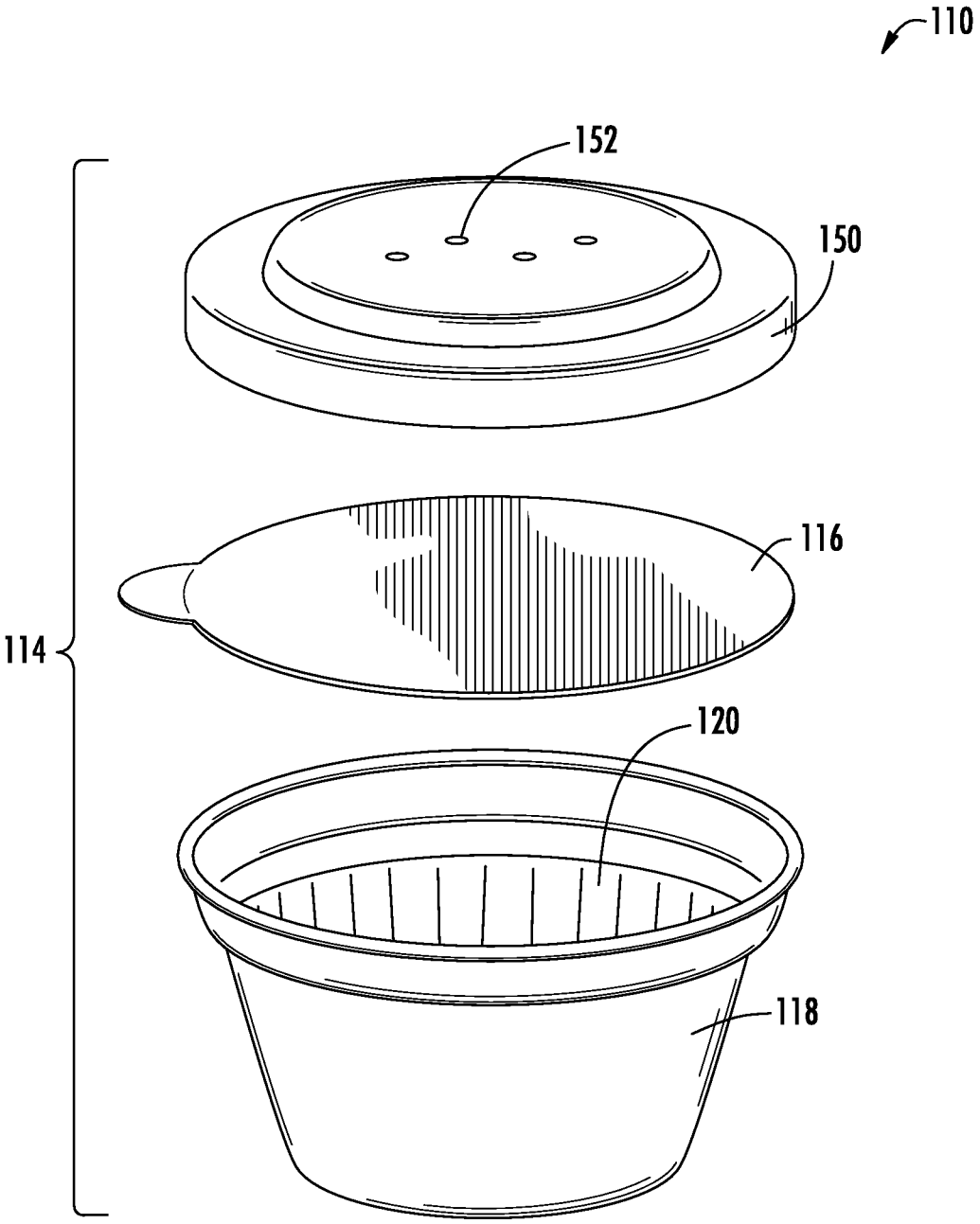
FIG. 4 is an exploded perspective view of a microwaveable product according to an exemplary embodiment.

Referring to FIG. 4, a microwaveable product 110 is shown according to an exemplary embodiment, and includes a food product (not shown) and a package 114. Package 114 is similar to package 14 discussed with respect to FIGS. 1-3 and may include a cover 116, a container 118, and a susceptor 120 provided within or as part of container 118. Additionally, a rigid cover 150 may be provided in addition to cover 116 such that product 110 includes both a rigid and a flexible (e.g., "tear-away") cover. Cover 150 may be configured such that cover 150 is easily removable by a user (e.g., a "pop-top" configuration), and may include a variety of features intended to facilitate the securing/removal of cover 150 to/from container 118. Providing a rigid polymer cover such as cover 150 may increase the durability of product 110. Cover 150 may be a rigid, polymer, vented cover or lid that facilitates heat transfer to the food product, and optimizes baking time and moisture exhaust. Cover 150 may be provided with one or more apertures 152 such that in one embodiment, product 110 may be heated after removing covers 116 and 150 and then replacing only cover 150. Alternatively, a portion of cover 116 may be "torn-away" and moisture may be vented through covers 116 and 150. As shown in FIG. 4, container 118 may have a generally flat exterior surface. According to an alternative embodiment, the exterior of container 118 may be corrugated or fluted in a similar fashion to container 18. Similarly, the interior of container 118 may be provided with a corrugated or fluted surface, and susceptor 120 may be provided as separate from or integral to container 118 and may have a corrugated or fluted construction.

Figure 5:
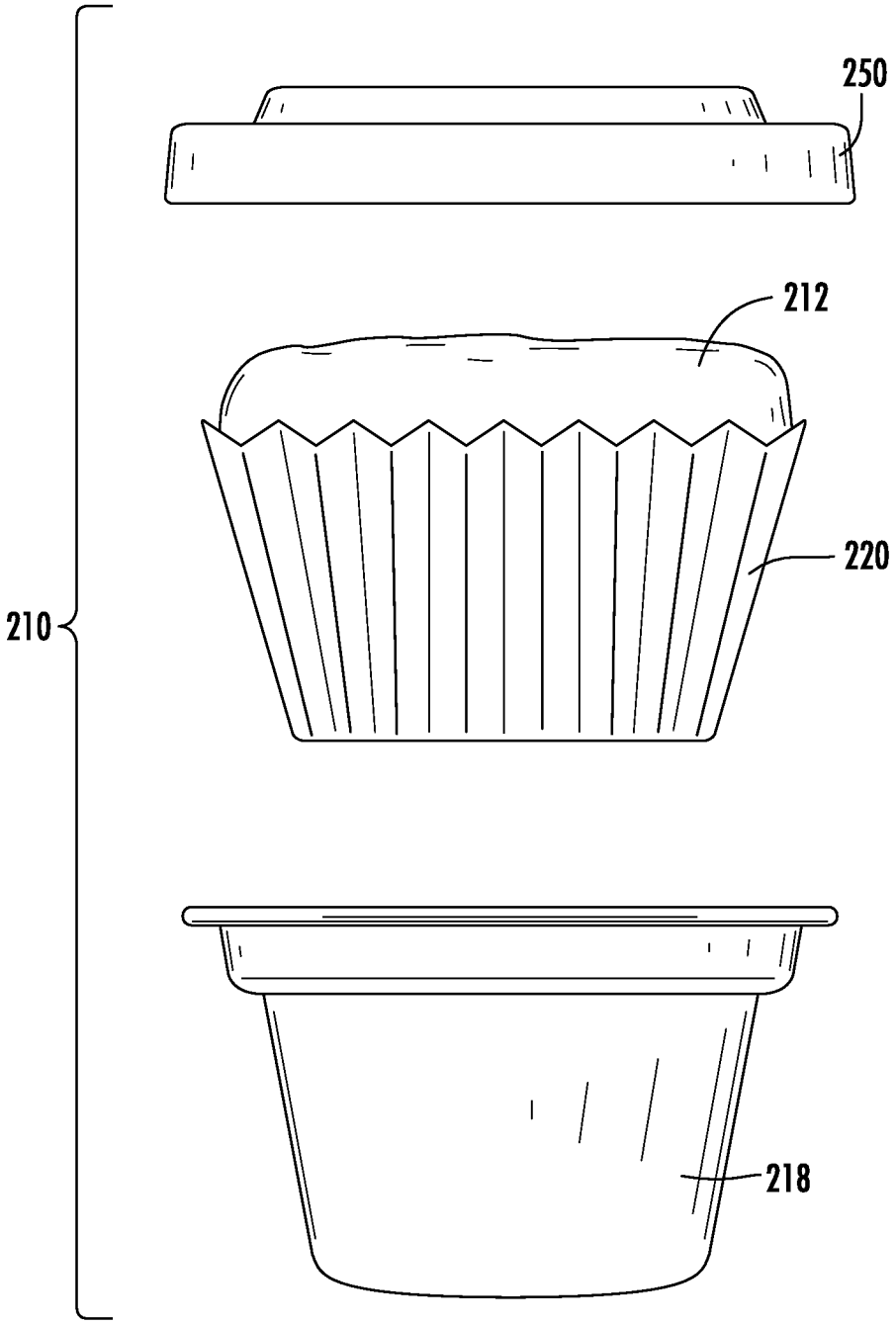
FIG. 5 is an exploded side view of a microwaveable product according to an exemplary embodiment.

Referring to FIG. 5, a microwaveable product 210 is shown according to an exemplary embodiment, and may include a food product 212, a container 218, a susceptor 220. However, rather than a flexible cover such as cover 16 shown in FIGS. 1-3, product 210 may be provided with a rigid cover 250 similar to cover 150 shown in FIG. 4. Cover 250 may be provided with apertures (not shown) to facilitate moisture release. Susceptor 220 may be provided as separate from or integral to container 218 and container 218 and/or susceptor 220 may have a corrugated construction.

Figure 6:
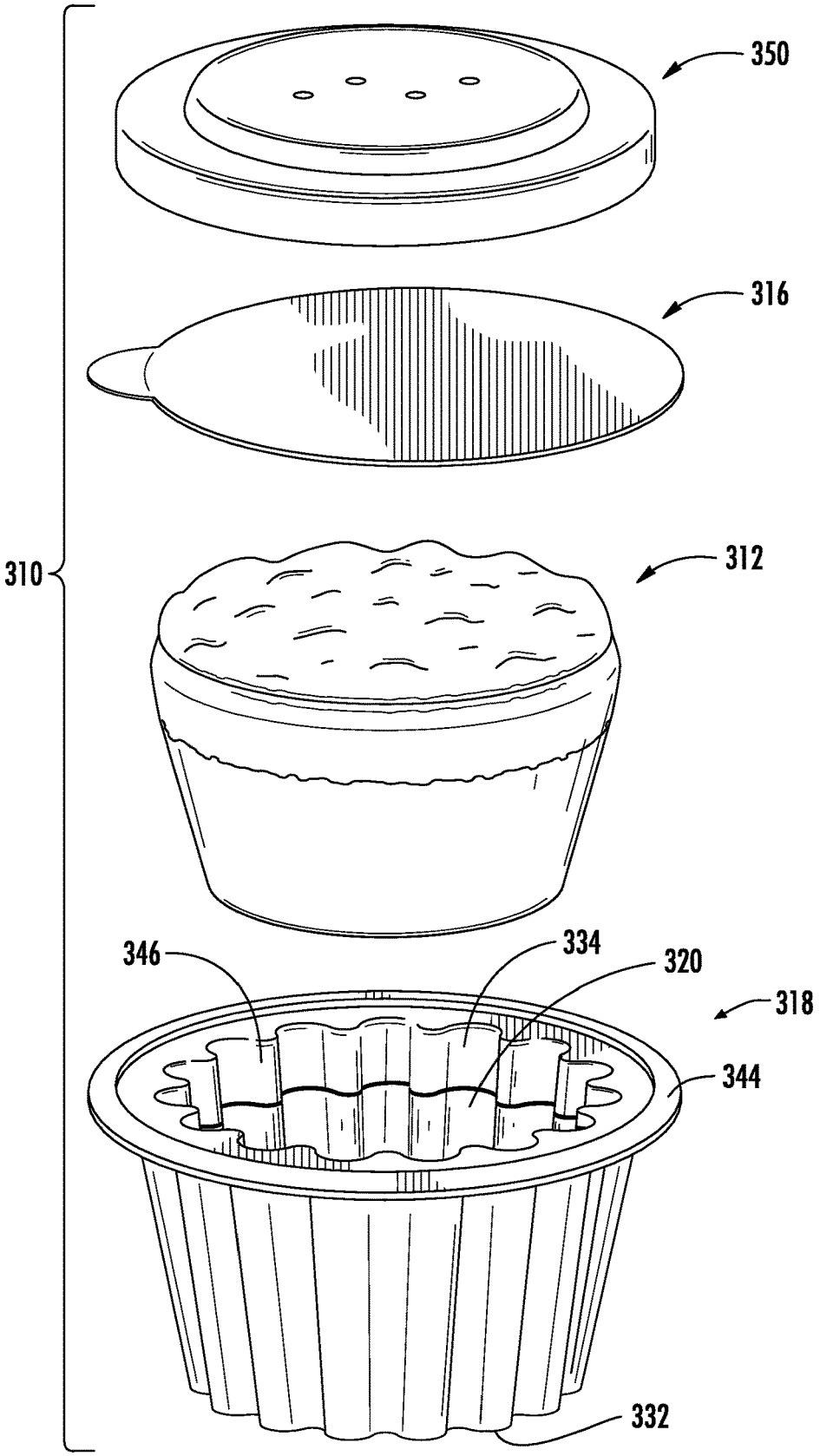
FIG. 6 is an exploded perspective view of a microwaveable product according to an exemplary embodiment.

Referring to FIG. 6, a microwaveable product 310 is shown according to another exemplary embodiment. As shown in FIG. 6, microwaveable product 310 may include a container 318, a food product 312, a flexible cover portion or lid 316 (e.g., a peelable and/or sealable material such as a film material, etc.), and a rigid or semi-rigid cover 350 (e.g., a polymer or flexible polymer cover, etc.). One or more components of microwave product 310 may be similar to corresponding components shown in one or more of FIGS. 1-5.

According to an exemplary embodiment, container 318 may have a fluted or corrugated construction that includes a number of wave-like flutes or corrugations 346 (e.g., waves, scallops, or similar corrugations or other features). According to one embodiment, container 318 may have approximately 15 corrugations 346 extending about the perimeter of container 318. According to another embodiment, the pitch of corrugations 346 may vary, and more or less corrugations 346 may be provided (e.g., 10, 20, 30, 35, etc.). Corrugations 346 may have a depth of approximately 0.14 inches, although according to various alternative embodiments, the corrugations may have other depths (e.g., more or less than 0.14 inches, such as 0.06 inches, 0.20 inches, etc.).

According to one embodiment, container 318 may include a sidewall 334 that extends between a bottom 332 and a lip portion 344. Container 318 may further include a susceptor inner portion or layer 320. Bottom 332 and sidewall 334 may be formed from a generally flat portion of paper material (e.g., a paper pulp material that may be provided in a generally circular shape), for example, via a thermoforming process where a paper material is formed around a mold portion to form the paper material into the shape of container 318. In some embodiments, susceptor 320 may be bonded or otherwise coupled or laminated to a paper material prior to forming container 318, such that sidewalls 334 and susceptor 320 are formed simultaneously during a process such as thermoforming. According to one embodiment, a paper material having a material thickness of approximately 0.025 inches (e.g., between 0.015 and 0.050 inches, between 0.020 and 0.030 inches, etc.) may be used to form sidewalls 334 and bottom 332.

In one embodiment, after forming sidewall 334 and bottom 332 from a paper material, lip portion 344 (e.g., flange, rim, etc.) may be formed through an injection-molding process to form a polymer lip portion that extends about the perimeter of the paper material forming sidewall 334 and bottom 332. According to an exemplary embodiment, lip portion 344 may be made from a polypropylene material, but may be made from various other materials according to various other exemplary embodiments. Sidewall 334 may further be "sloped" from bottom to top, as discussed in greater detail with respect to FIGS. 1-3.

Various modifications of the components of the microwaveable products shown according to the various exemplary embodiments may be made. For example, a susceptor having a corrugated construction may be provided separate from a corresponding container and/or cover according to an exemplary embodiment (e.g., a six ounce container and a corresponding perforated polymer cover). According to exemplary embodiments, food products may be provided having textured exterior surfaces resulting from the construction and use of a corrugated susceptor/container. According to any of these embodiments or other embodiments disclosed herein, the container, cover, susceptor and other components of the microwaveable product may be provided as either rigid or flexible components to suit a particular application. Furthermore, while the microwaveable package is shown having a generally circular cross-section, other shapes and configurations, such as square, rectangular, etc., may be used, It should be noted that the various features of the microwaveable products disclosed herein may be used in a wide variety of applications, alone, or in combination. For example, one or more features of microwaveable product 10 discussed with respect to FIGS. 1-3 may be used in conjunction with or instead of one or more features of microwaveable product 110 discussed with respect to FIG. 4 and/or microwaveable products 210, 310 discussed with respect to FIGS. 5-6. All such combinations of features are intended to be within the scope of the present disclosure.

It is important to note that the terms "container," "package," "susceptor," and "food product" are intended to be broad terms and not terms of limitation. These terms may be used with any of a variety of products or arrangements and are not intended to be limited to use with particular applications.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to a mechanical or fluid relationship between the two components.

It is also important to note that the construction and arrangement of the elements of the microwaveable product as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present disclosure as defined in the appended claims. The order or sequence of any process or method steps may be varied or re-sequenced according to alternative embodiments. Other substitutions, modifications, changes and/or omissions may be made in the design, operating conditions and arrangement of the exemplary embodiments without departing from the spirit of the present disclosure.

What is claimed is:

1. A microwaveable product comprising:

a container comprising a bottom and a fluted container sidewall, the fluted container sidewall extending from the container bottom to a first height;

a susceptor comprising a fluted susceptor sidewall, the fluted susceptor sidewall extending along the fluted container sidewall from the container bottom to a second height, the second height being less than the first height;

a food disposed within the container;

a lower portion of an outer surface of the food being fluted and nested against the fluted susceptor sidewall, the lower portion of the outer surface of the food defining a closed geometry in a plane parallel to one or both of the container bottom and a bottom of the susceptor;

wherein an upper portion of an outer surface of the food extends from below the second height to above the second height and is nested against the fluted container sidewall, the upper portion of the outer surface of the food being fluted and defining a closed geometry in a plane parallel to one or both of the container bottom and the bottom of the susceptor;

wherein the fluted susceptor sidewall is nested against the fluted container sidewall such that the container flutes defined by the container sidewall seat the susceptor flutes defined by the susceptor sidewall.

2. The product of claim 1, wherein the container and the susceptor both contribute to defining a continuous chamber in which all of the food is disposed.

3. The product of claim 1, wherein the container further comprises a rim radially projecting from the fluted container sidewall.

4. The product of claim 3, wherein the rim is made from polymer while the fluted container sidewall is made from paper material.

5. The product of claim 1, wherein the food is exclusively disposed between the container bottom and the first height, the fluted container sidewall being fluted from the container bottom to the first height.

6. The product of claim 1 comprising a lid sealed to the container;

the lid, the container, and the susceptor contributing to define a continuous chamber in which all of the food is disposed;

one side of the lid being directly exposed to ambient environment, the opposing side of the lid being directly exposed to the inner chamber.

7. The product of claim 1, configured such that during microwaving of the product: the lower portion of the food is directly exposed to heat produced by the susceptor, while the upper portion of the food is not directly exposed to heat produced by the susceptor.

8. The product of claim 7, wherein the food comprises dough that is cup-shaped and meat is placed within the cup-shaped dough.

9. The product of claim 8, wherein the dough is uncooked and the meat is cooked.

10. The product of claim 1, wherein the susceptor comprises a bottom, the susceptor bottom being flushly seated against the container bottom.

11. The product of claim 1 comprising a lid sealed to the container at the first height.

12. The product of claim 11, wherein the container comprises a rim to which the lid is directly sealed.

13. The product of claim 12, wherein the container rim is polymeric to enable heat sealing between the container rim and the lid while the fluted container sidewall is non-polymeric.

14. The product of claim 13, wherein the food comprises dough.

15. The product of claim 14, wherein the dough is fluted by virtue of being pressed against the fluted susceptor sidewall.

* * * * *